US007129403B2

(12) United States Patent
Wroblewski

(10) Patent No.: US 7,129,403 B2
(45) Date of Patent: Oct. 31, 2006

(54) FRICTION AT THE JACK AND KNUCKLE INTERFACE IN A GRAND PIANO ELIMINATED

(76) Inventor: Richard Wroblewski, 701 Silver La., Trumbull, CT (US) 06611

( * ) Notice: Subject to any disclaimer, the term of this patent is extended or adjusted under 35 U.S.C. 154(b) by 0 days.

(21) Appl. No.: 10/878,002

(22) Filed: Jun. 29, 2004

(65) Prior Publication Data

US 2005/0284279 A1 Dec. 29, 2005

(51) Int. Cl.
*G10C 3/18* (2006.01)

(52) U.S. Cl. ..... 84/239; 84/433

(58) Field of Classification Search ..... 84/239, 84/240, 236, 255, 241, 242, 253, 217, 218, 84/433

See application file for complete search history.

(56) References Cited

U.S. PATENT DOCUMENTS 269,405 A * 12/1882 Gemunder ..... 84/239

5,911,167 A * 6/1999 Jones et al. ..... 84/236

* cited by examiner

*Primary Examiner*—Lincoln Donovan
*Assistant Examiner*—Jianchun Qin

(57) ABSTRACT

A grand piano action the jack having a projection acting against the knuckle dependent from the hammer shank carrying the piano hammer by a counter weight carried by the jack eliminating the spoon and the regulating button and the jack spring pressing against the jack causing the traditional excessive friction at the jack and knuckle interface.

Friction is totally eliminated from the conventional grand piano action by the capstan screw on the piano key lifting the wippen lever near the pivot of the jack.

Patents relating to the problem of excessive friction. Finholm U.S. Pat. No. 4,774,868. Steinway U.S. Pat. No. 5,511,454-U.S. Pat. No. 5,911,167. Baldwin U.S. Pat. No. 6,232,537.

27 Claims, 13 Drawing Sheets

FRICTION AT THE JACK AND KNUCKLE INTERFACE IN A GRAND PIANO ELIMINATED

FIELD OF THE INVENTION

The present invention relates to grand pianos affected by excessive friction at the Jack and knuckle interface.

BACKGROUND OF THE INVENTION

Conventional grand pianos are plagued by excessive friction at the Jack and knuckle interface causing noise, wear and tear, requiring frequent regulation and lubricant being applied to the jack and knuckle. Friction at the Jack and knuckle interface is caused primarily by the wippen lever carrying the jack not working with the principle of Archimedes. The capstan screw on the piano key is too much away of the distal end of the wippen lever. This friction is also caused by the jack spring pressing downwardly upon the jack and wippen lever and by gravity of the hammer assembly.

SUMMARY OF THE INVENTION

In the present invention friction at the jack and knuckle interface is reduced by replacing the jack spring with a counter weight carried by the jack to operate by gravity. In another embodiment the jack is pulled by an adjustable spiral spring horizontally. A projection on the jack acting against the knuckle eliminates the spoon on the wippen lever and the regulating button carried by the jack.

The capstan screw on the piano key lifting the wippen lever close to the distal end eliminates completely this friction.

BRIEF DESCRIPTION OF THE DRAWINGS

FIG. 2 Shows the jack carrying an insert projection acting against the knuckle by a counter weight carried by the jack.

FIG. 3 shows a spiral spring holding the jack in position.

FIGS. 4–5 show the jack carrying a counter weight.

FIG. 6 shows the jack carrying a counter weight, the capstan screw on an adjustable stage being under the end of the wippen lever.

FIG. 7 shows the projection passing through an opening in The hammer shank.

FIG. 8 shows the capstan screw under the end of the wippen lever.

FIG. 9 shows regulating screws regulating tension of the springs.

FIG. 10 is similar to FIG. 9.

FIG. 11 shows The jack carrying a counter weight.

DESCRIPTION OF THE PREFERRED EMBODIMENTS

Figure 2:
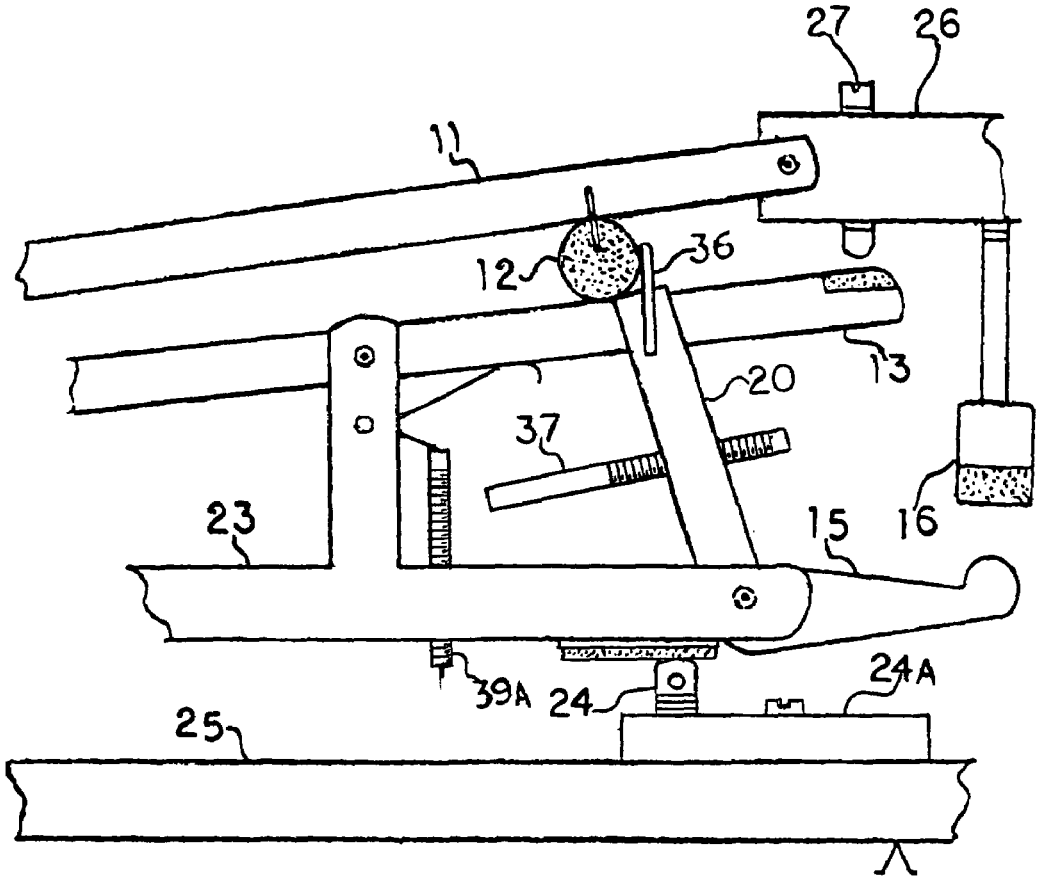
FIGS. 2–11 show side views of the present invention

FIG. 2 shows the jack 20 carrying a counter weight screw 37, effectuating the projection insert 36 to act against knuckle 12, the capstan screw 24 on adjustable stage 24A lifting the distal end of the wippen lever 23 completely eliminates friction at the jack and knuckle interface.

Figure 2A:
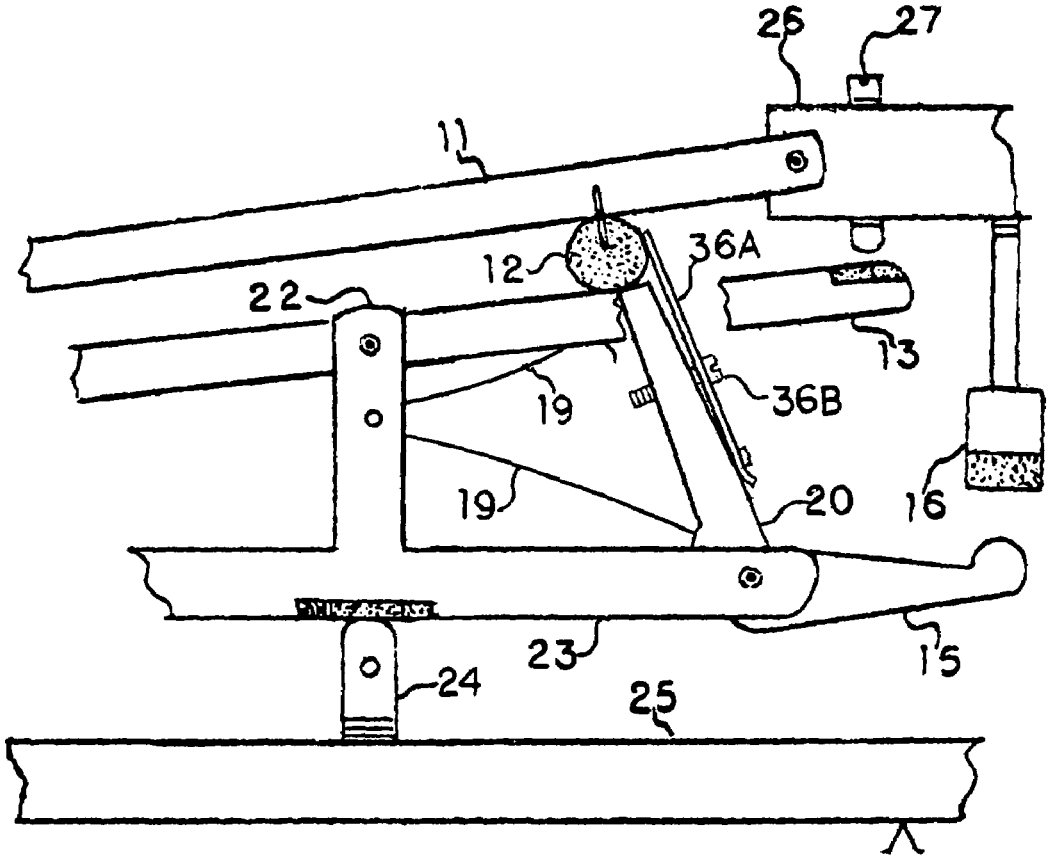
FIG. 2A shows an adjustable spring attached to the jack acting against the knuckle.
Figure 9:
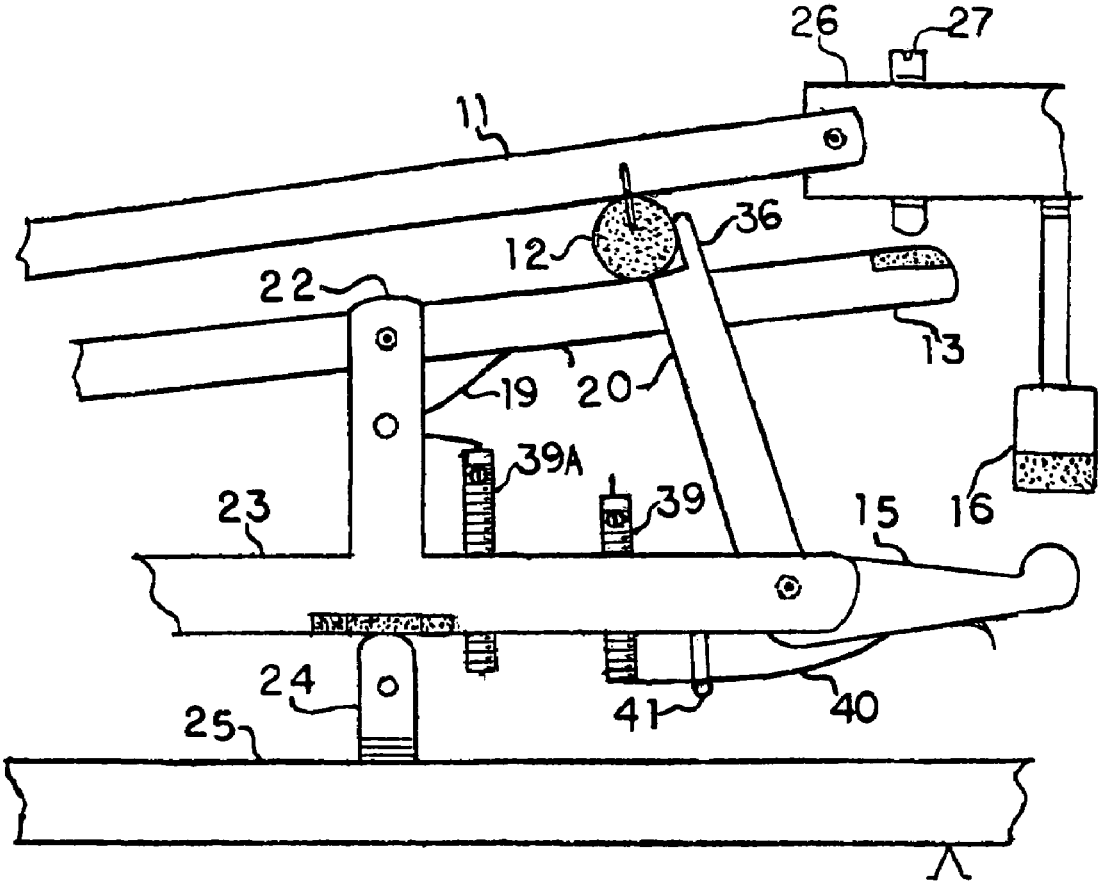
Figure 11:
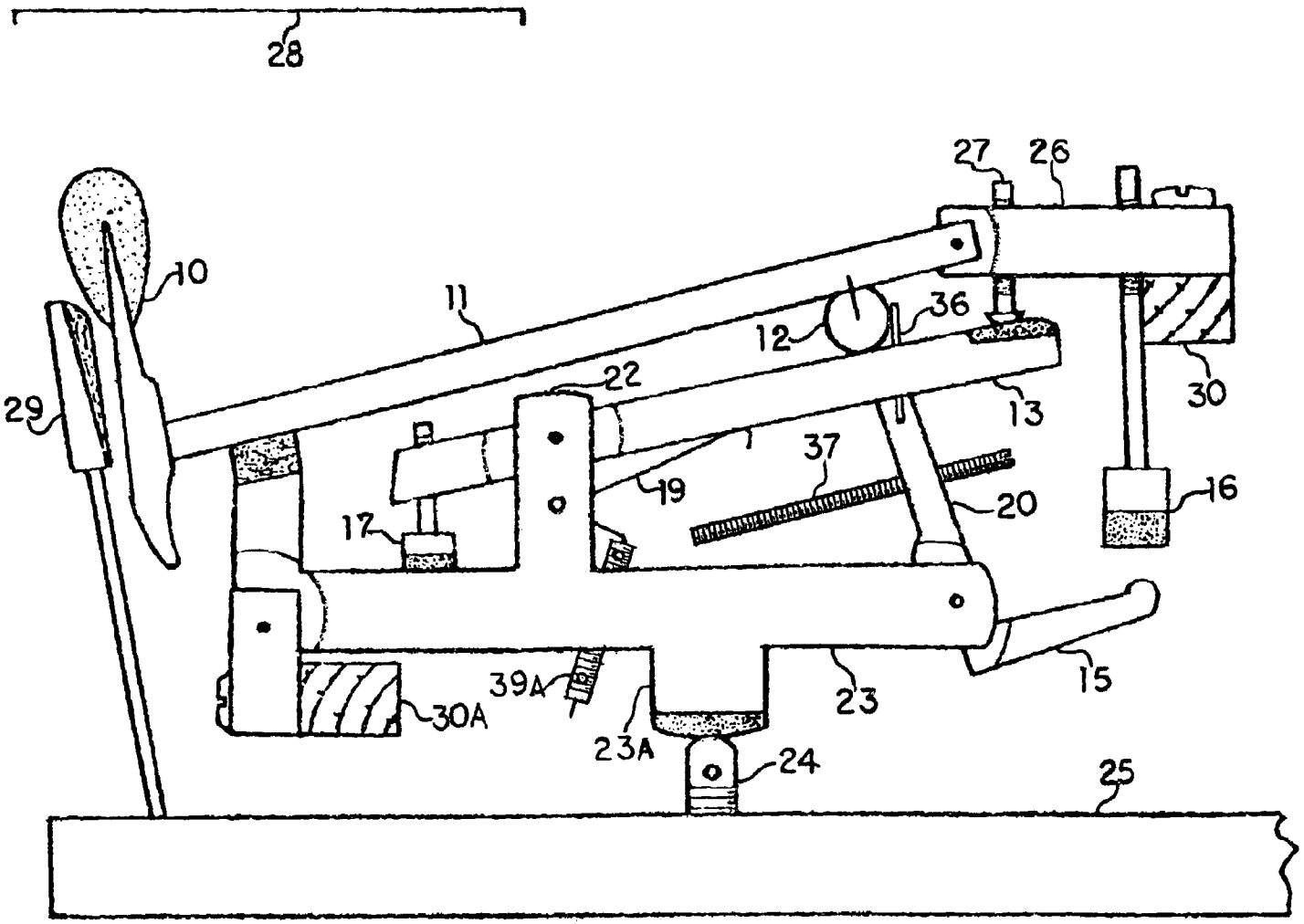
Figure 12:
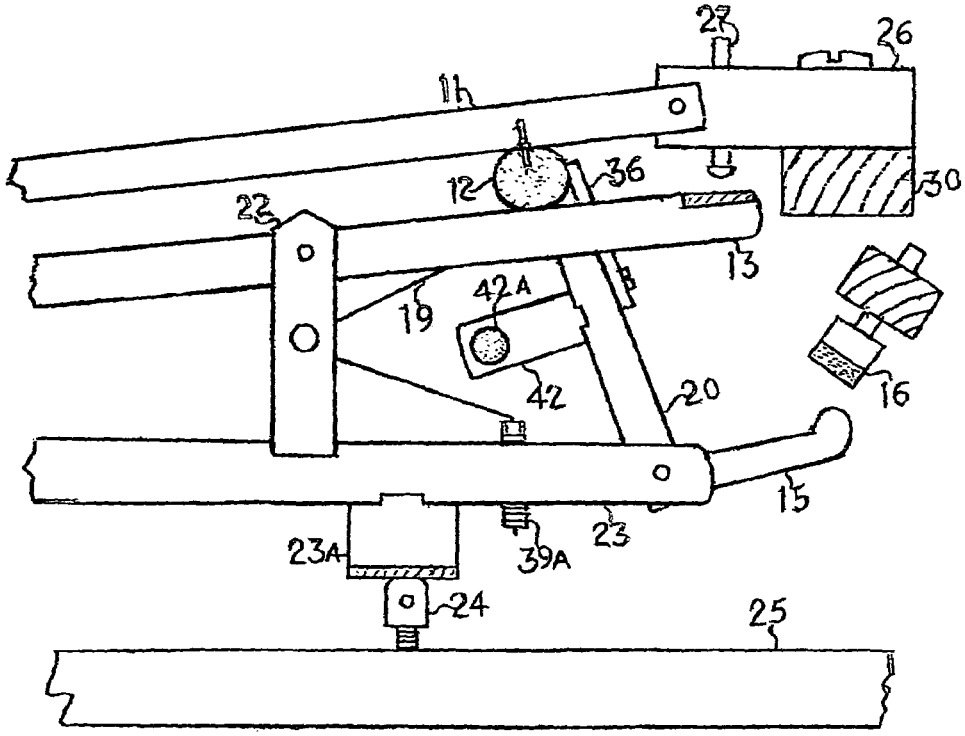
FIG. 12 shows the jack carrying a member carrying a lead insert.

FIG. 2A shows the projection acting against the knuckle as shown in FIGS. 2, 9, 11, being a flat spring 36A attached to the jack 20, a regulating screw 36B in a hole in the flat spring projection 36A regulates the position of the lifting surface of the jack 20 with respect to the underside of the knuckle 12.

Figure 3:
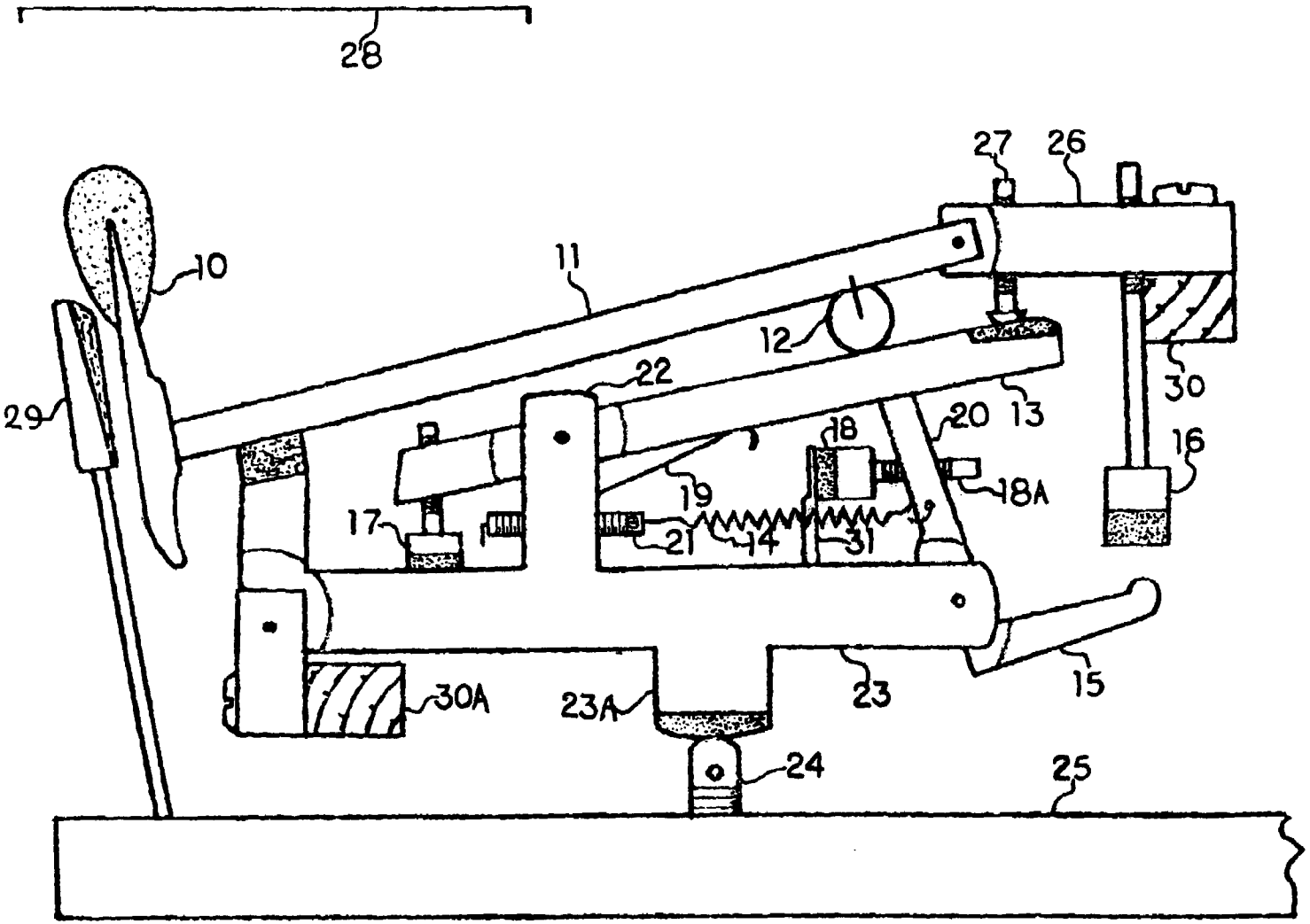

FIG. 3 shows the jack 20 being pulled by the convoluted spring 14 extending from the regulating screw 21 carried by the vertical portion 22 of the wippen lever 23.

Figure 4:
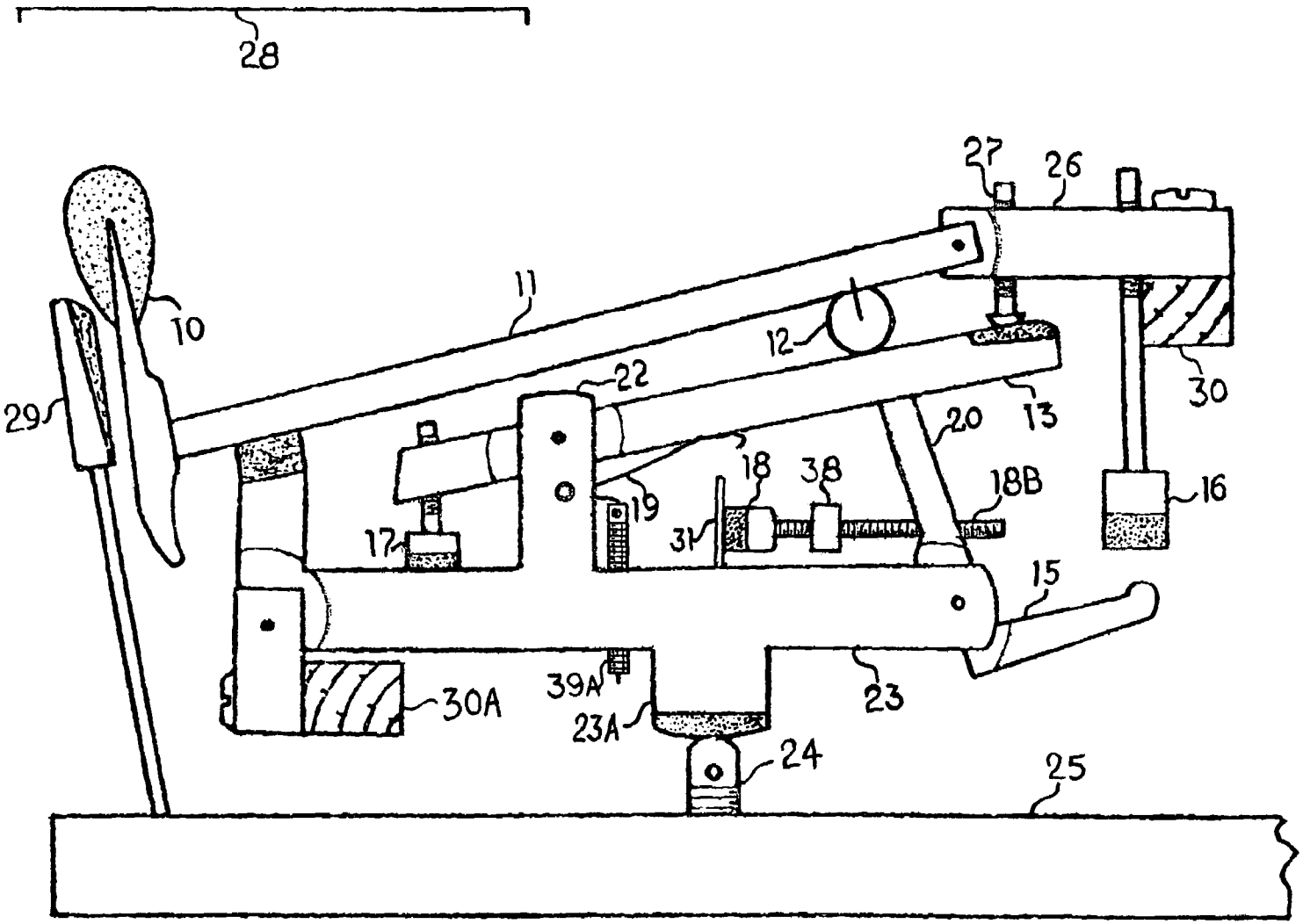

FIG. 4 shows the jack 20 carrying a screw 18B carrying a lead weight 38, the button 18 acting against the spoon 31 by the lead weight operating by gravity.

Figure 5:
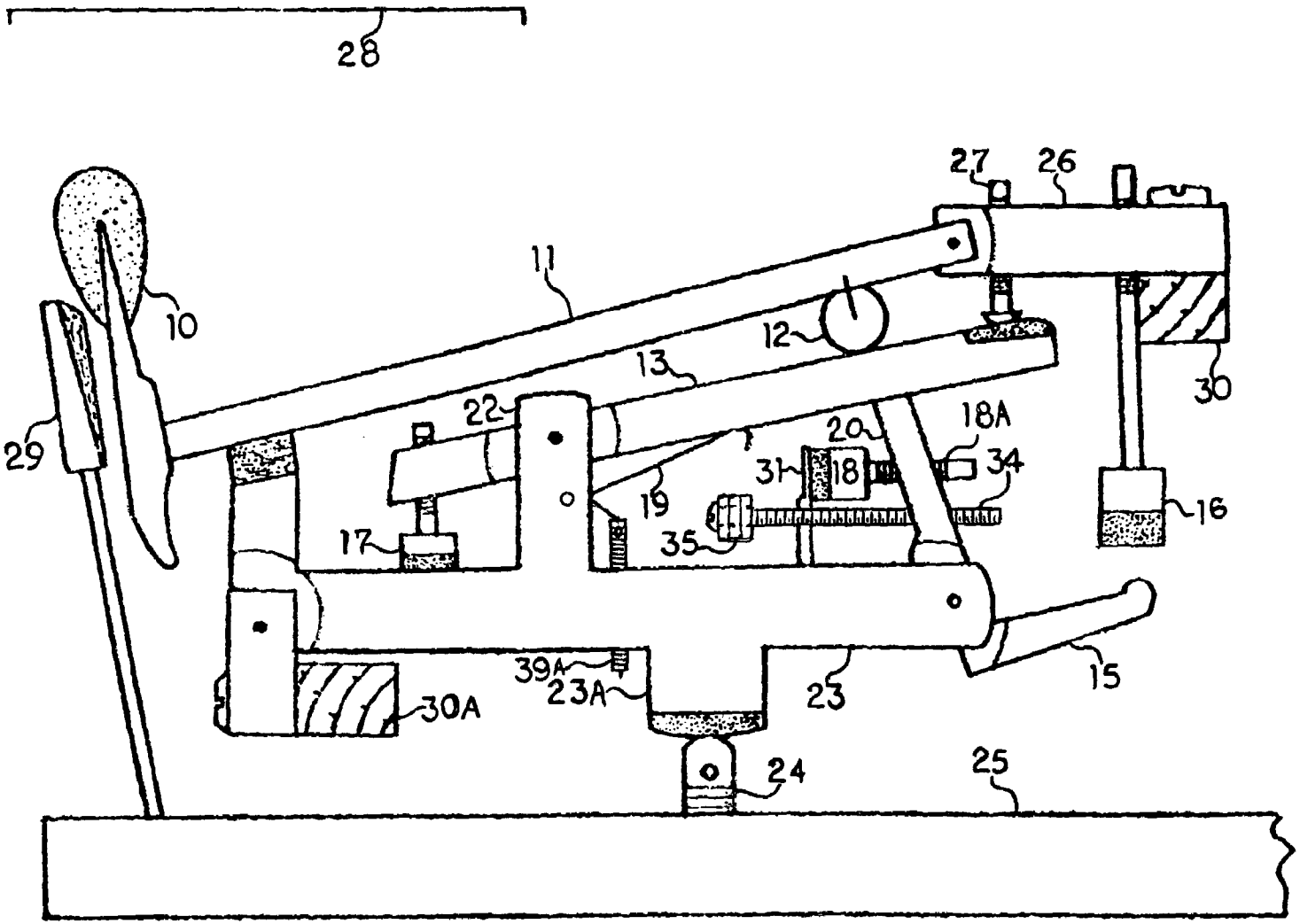

FIG. 5 shows the jack 20 carrying a screw 34 carrying several screw nuts 35, acting as counter weights operating by gravity.

Figure 1:
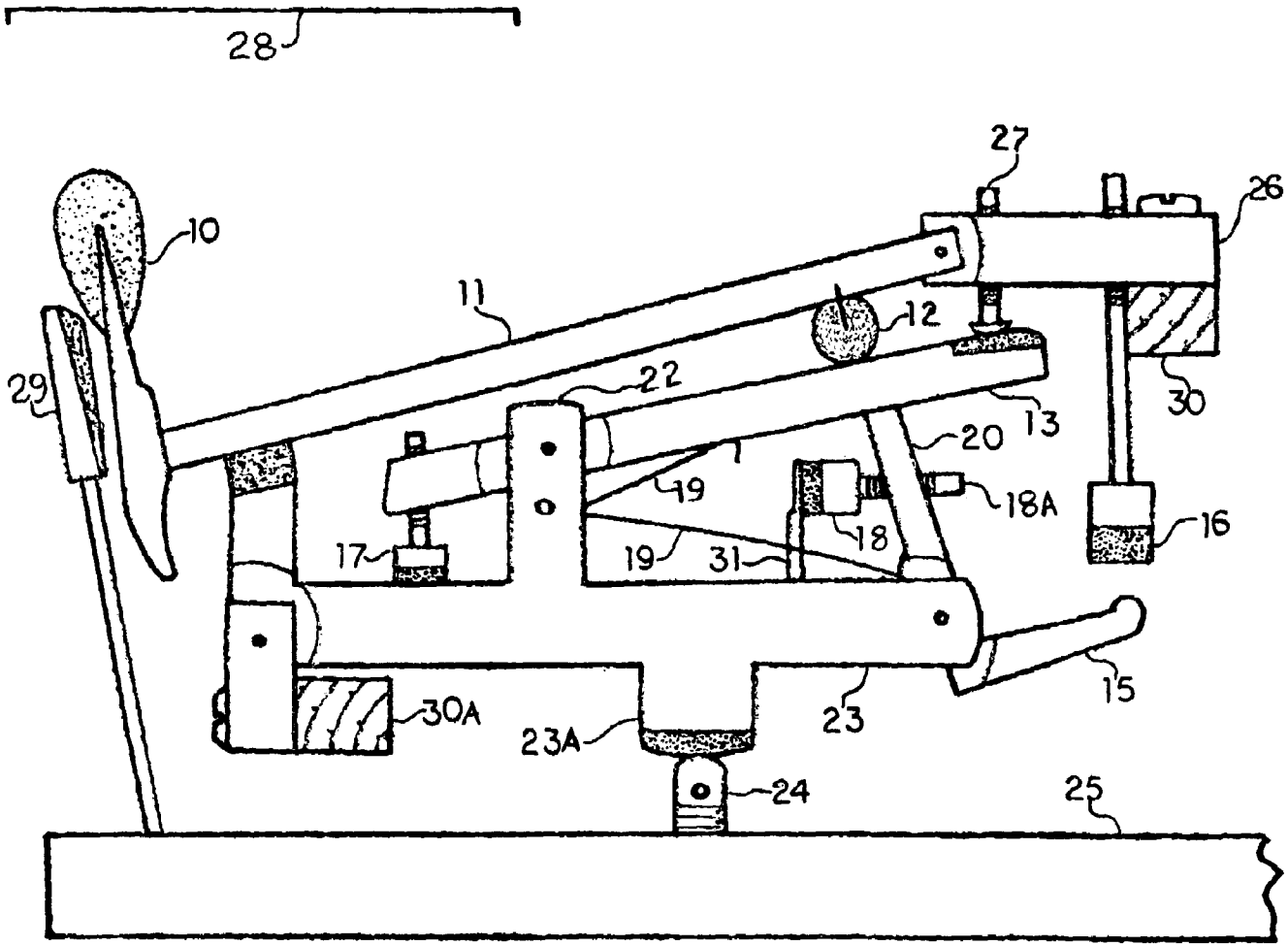
FIG. 1 PRIOR ART
FIG. 1 shows side view of prior art
Figure 6:
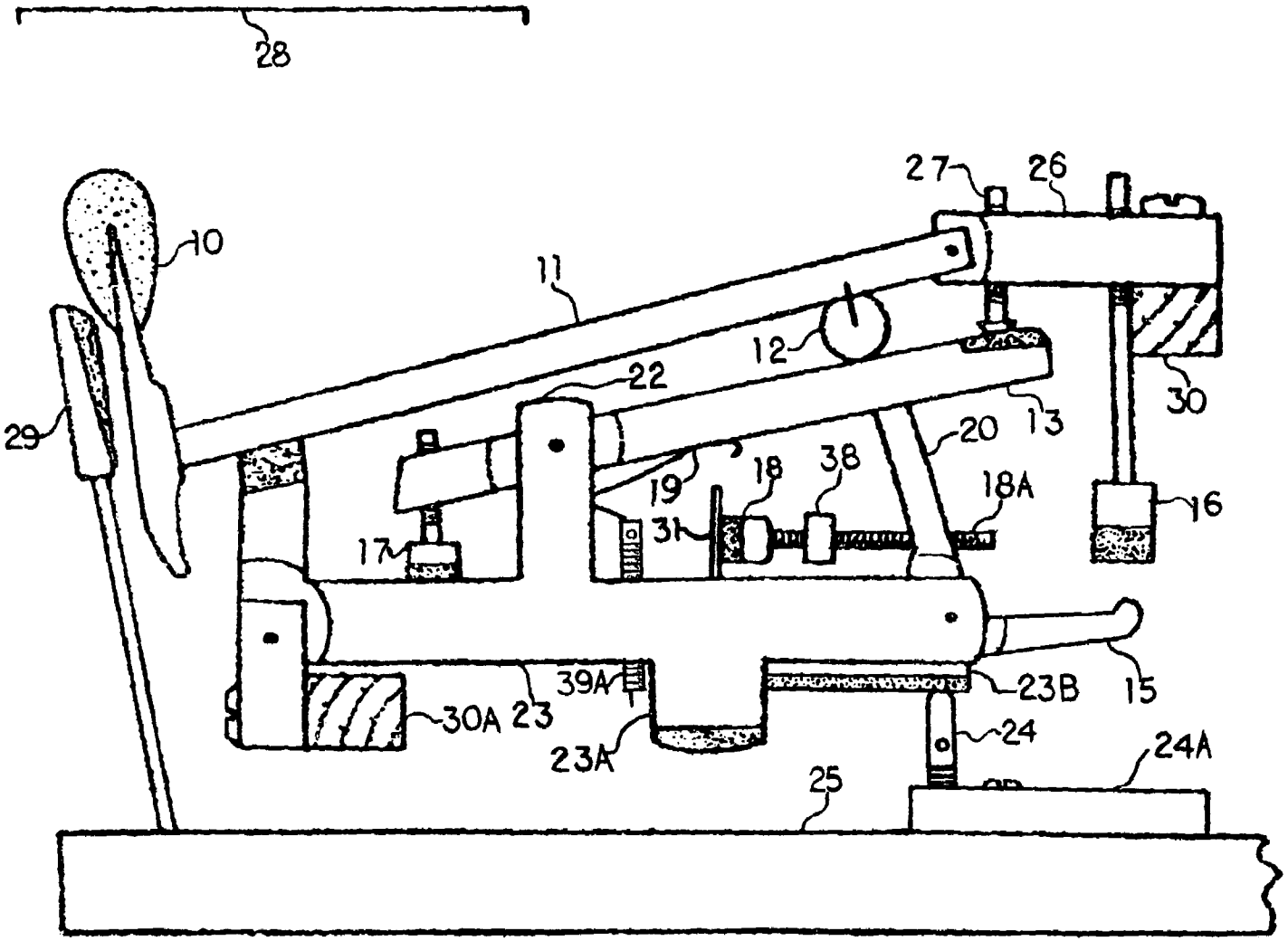

FIG. 6 shows the piano key 25 carrying an adjustable stage 24A carrying the capstan screw 24, a platform 23B extending from the traditional appendage 23A to the distal end of the wippen lever 23, the capstan screw 24 on the stage 24A being regulated along the platform 23B from the traditional appendage 23B to the distal end of the wippen lever 23 regulating the leverage of the wippen lever 23. The capstan screw 24 lifting the distal end of the wippen lever 23 resulting in a very light piano key with zero friction at the jack and knuckle interface in a conventional grand piano action with original springs acting against the repetition lever and the jack as shown in FIG. 1 Prior Art.

The greater the distance between the appendage and the capstan screw, the greater the leverage of the wippen lever, the greater the reduction of the traditional friction at the jack and knuckle interface.

Figure 7:
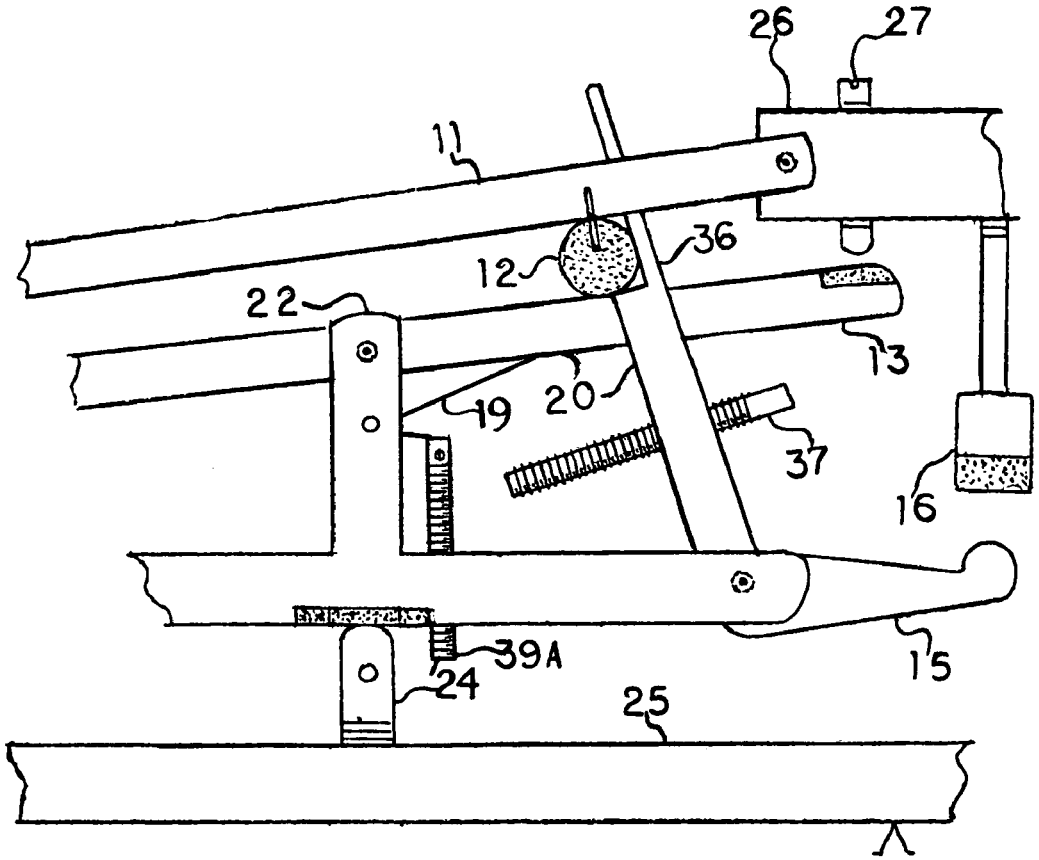

FIG. 7 shows the projection 36 being integral to the jack 20.

Figure 8:
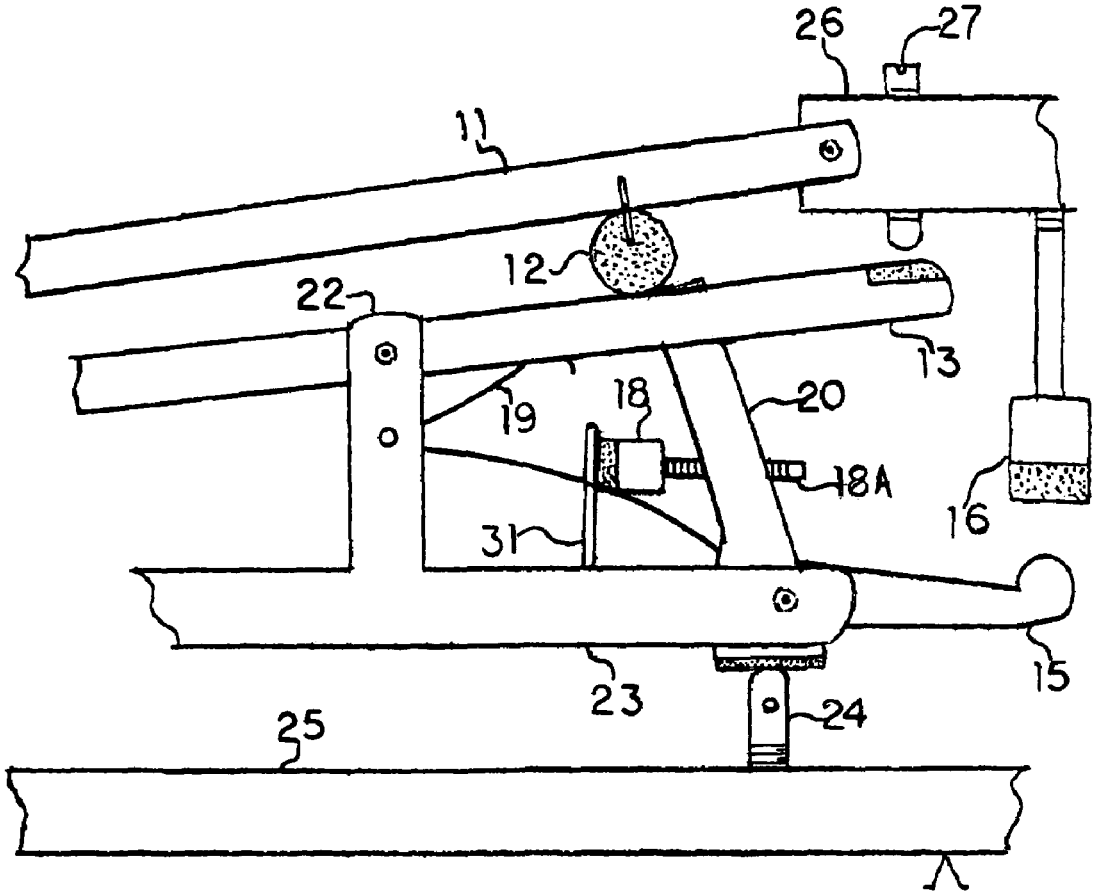

FIG. 8 shows capstan screw 24 supporting distal end of the wippen lever 23 in a conventional arrangement.

FIG. 9 shows regulating screw 39A regulating tension of repetition spring 19, regulating screw 39 regulating tension of jack spring 40 under arm 15 of the jack 20 about abutment 41.

Figure 10:
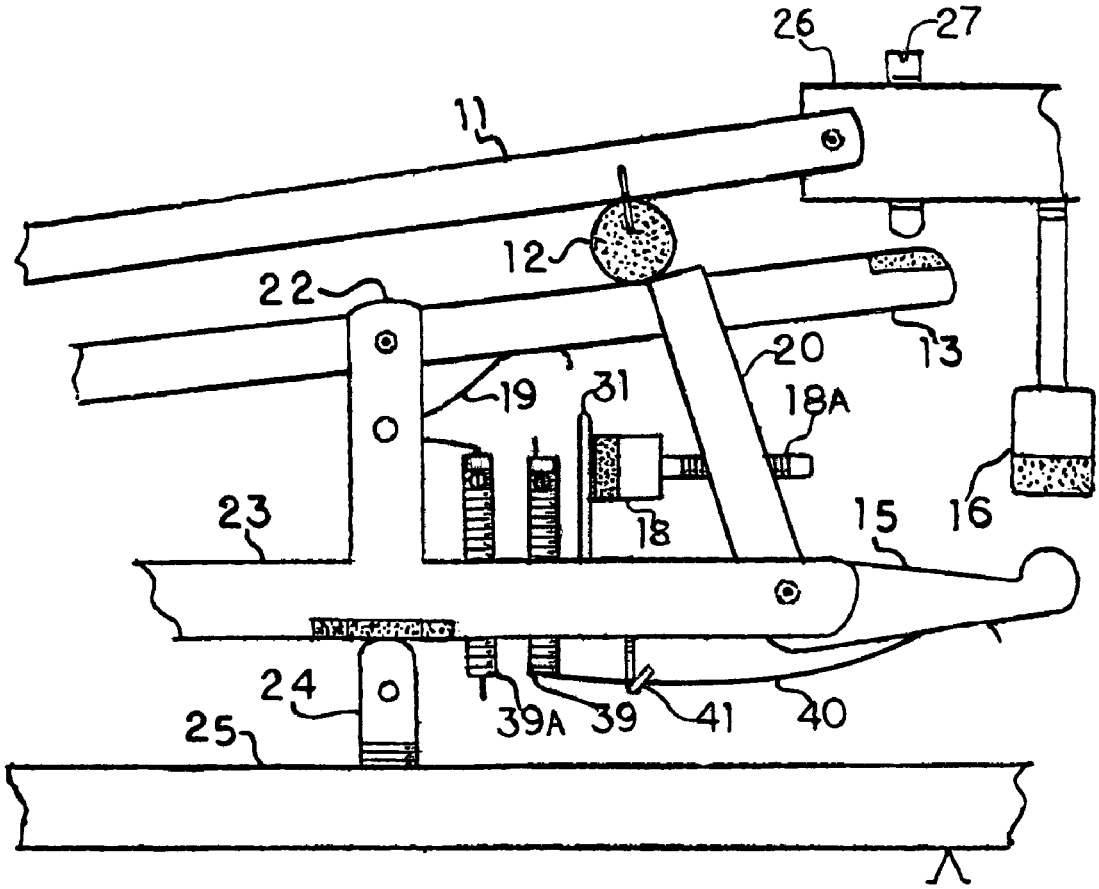

FIG. 10 shows regulating screw 39A regulating tension of repetition spring 19, regulating screw 39 regulating tension of jack spring 40 as in FIG. 9, regulating button 18 carried by the jack 20 acting against spoon 31 by the jack spring 40.

FIG. 11 shows jack 20 carrying a counter weight screw 37 effectuating projection insert 36 on top of the jack 20 to act against the knuckle 12 by gravity.

REFERENCE NUMERALS FIGS. 1–11

10 piano hammer
11 hammer shank
12 knuckle
13 repetition lever
14 convoluted spring
15 arm of jack 20
16 escapement button
17 regulating button
18 regulating button
18A regulating screw
18 regulating button
19 spring
20 jack
21 regulating screw
22 vertical portion of wippen
23 wippen lever

23A traditional appendage
23B wippen platform
24 capstan screw
24A adjustable stage
25 piano key
26 flange
27 regulating drop screw
28 piano string
29 hammer back check
30 rail
30A rail
31 spoon
34 screw
35 screw nuts
36 projection
37 threaded rod
38 lead counter weight
39–39A regulating screw
40 spring
41 abutment

I claim:

1. A grand piano action comprising a flange carrying a hammer shank carrying a piano hammer and a knuckle; a jack being carried by a wippen lever; a capstan screw on the piano key supporting said wippen lever; an arm of said jack opposing an escapement let off button; a vertically oriented portion of said wippen lever carrying a double ended spring; said wippen lever carrying a regulating screw, the first end of said spring supporting a repetition lever, the second end of said spring being in a hole along said regulating screw; the top of said jack having a projection, said projection acting against said knuckle by a counter weight carried by said jack; said capstan screw on said piano key being positioned on said piano key at a selected distance from the distal end of said wippen lever for a selected amount of friction between said jack and said knuckle; the lesser said distance the lesser said friction between said jack and said knuckle the greater said distance the greater said friction between said jack and said knuckle; said capstan screw positioned on said piano key under said distal end of said wippen lever eliminating completely said friction between said jack and said knuckle.

2. The grand piano action according to claim 1 wherein said capstan screw on said piano key supporting said wippen lever being positioned on said piano key near the pivot of said jack completely eliminating said friction between said jack and said knuckle.

3. The grand piano action according to claim 1 wherein said projection being an insert carried by said top, of said jack next to its lifting surface, said insert acting against the side of said knuckle by said counter weight carried by said jack.

4. The grand piano action according to claim 3 wherein said insert an said top of said jack being at an angle.

5. The grand piano action according to claim 1 wherein said projection being integral to said jack being configured from the upper portion of said jack, said projection acting against the side of said knuckle by said counter weight carried by maid jack.

6. The grand piano action according to claim 1 wherein said capstan screw on said piano key supporting said wippen lever being positioned on said piano key close to the distal end of said wippen lever.

7. The grand piano action according to claim 6 wherein said capstan screw supporting said wippen lever being on a stage adjustable along said piano key.

8. The grand piano action according to claim 1 wherein said counter weight carried by said jack being a threaded rod of a prescribed length at diameter being in a threaded hole.

9. The grand piano action according to claim 1 wherein said projection passing through an opening in said hammer shank.

10. The grand piano action according to claim 1 wherein said projection acting against said knuckle being carried by the back side of said jack.

11. The grand piano action according to claim 1 wherein said counter weight carried by said jack being adjustable.

12. The grand piano action according to claim 1 wherein said projection acting against, said knuckle being a flat spring means attached to the back side of said jack; said flat spring means having a hole for a regulating screw, said regulating screw being in a threaded hole in said jack regulating position of the lifting surface of said jack under said knuckle by said projection acting against said knuckle effected by said counter weight carried by said jack.

13. The grand piano action according to claim 1 wherein said jack being configured with a protrusion extending in a direction toward said piano hammer for said projection to act against said knuckle by the gravity of said protrusion.

14. The grand piano according to claim 13 wherein said protrusion including a lead counter weight inserted into an opening in said protrusion for said projection to act against said knuckle by the gravity of said protrusion and said lead counter weight.

15. A grand piano action comprising a flange carrying a hammer shank carrying a piano hammer and a knuckle said knuckle resting on a repetition lever, said repetition lever being carried by a vertically oriented portion of a wippen lever, said wippen lever carrying a jack said a spoon, a regulating screw passing through said jack carrying a button, said button adjoining said spoon, said wippen lever including a regulating screw having a hole along said regulating screw, a spring in said hole adjoining the underside of an arm of said jack, said regulating screw regulating tension of said spring about an abutment dependent from said wippen lever; said wippen lever including a second regulating screw having a hole along said regulating screw; said vertically oriented portion of said wippen lever carrying a spring, the first portion of said spring supporting said repetition lever, the second portion of said spring being in said hole along said regulating screw, said regulating screw regulating tension of said first portion of said spring supporting said repetition lever, a capstan screw on the piano key supporting said wippen lever.

16. The grand piano action according to claim 15 wherein a convoluted spring means connecting said jack to said vertically oriented portion of said wippen lever effectuating said button to act against said spoon.

17. The grand piano action according to claim 16 wherein said vertically oriented portion of said wippen lever including a regulating screw having a hole along said regulating screw, the straight portion of said convoluted spring means being in said hole, the end being bent over the end of said regulating screw, the end of the convoluted portion being formed into a hook passing through a hole in said jack.

18. The grand piano action according to claim 15 wherein said regulating screw passing through said jack including an adjustable lead weight between said jack and said button carried by said regulating screw effectuating said button to act against said spoon.

19. The grand piano action according to claim 18 wherein said jack including a regulating screw as a weight effectuating said button to act against said spoon.

20. The grand piano action according to claim 19 wherein said regulating screw carrying several screw nuts acting as weights effectuating said button to act against said spoon.

21. A grand piano action comprising a flange carrying a hammer shank carrying a piano hammer and a knuckle, said knuckle resting on a repetition lever, said repetition lever being carried by a vertically oriented portion of a wippen lever; said wippen lever carrying a jack at the distal end of said wippen lever; a first end of a traditional spring carried by said vertically oriented portion of said wippen lever supporting said repetition lever, the second end of said traditional spring supporting said jack; a capstan screw on the piano key supporting said wippen lever at a selected point between the traditional appendage and said distal end of said wippen lever; the greater the distance between said appendage and said capstan screw the greater the leverage of said wippen lever the lesser the friction at the jack at knuckle interface.

22. The grand piano action according to claim 21 wherein said capstan screw being on said adjustable stage on said piano key to adjoin said selected point on said wippen lever between said traditional appendage and said distal end of said wippen lever.

23. The grand piano action according to claim 22 wherein said wippen lever including a platform extending from said traditional appendage to said distal end of said wippen lever; said capstan screw adjoining said distal end.

24. The grand piano action according to claim 21 wherein said jack including a regulating button acting against a spoon carried by said wippen lever by a convoluted spring means connecting said jack to said vertically oriented portion of said wippen lever.

25. The grand piano action according to claim 24 wherein said vertically oriented portion of said wippen lever including a regulating screw having a hole along said regulating screw; a straight portion of said convoluted spring means being in said hole, the end being bent over the end of said regulating screw, the other end of said convoluted spring means being attached to said jack.

26. The grand piano action according to claim 21 wherein said distal end of said wippen lever carrying said jack including an appendage, said capstan screw on said piano key supporting said appendage.

27. In a conventional grand piano action the jack carried by the wippen lever including a projection acting against the knuckle dependent from the hammer shank carrying the piano hammer, said projection being a flat spring means attached to the back side of said jack, said flat spring means having a hole for a regulating screw, said regulating screw being in a threaded hole in said jack regulating position of the lifting surface of said jack under said knuckle by said projection acting against salt knuckle effected by the conventional jack spring biasing said jack.

* * * * *